United States Patent [19]

Dorfman

[11] Patent Number: 4,872,904

[45] Date of Patent: Oct. 10, 1989

[54] TUNGSTEN CARBIDE POWDER AND METHOD OF MAKING FOR FLAME SPRAYING

[75] Inventor: Mitchell R. Dorfman, Smithtown, N.Y.

[73] Assignee: The Perkin-Elmer Corporation, Norwalk, Conn.

[21] Appl. No.: 201,507

[22] Filed: Jun. 2, 1988

[51] Int. Cl.[4] ..... B22F 9/00

[52] U.S. Cl. ..... 75/0.5 BA; 75/251; 419/18

[58] Field of Search ..... 75/0.5 B, 0.5 BB, 0.5 BC, 75/0.5 R, 251-255; 419/26, 32, 18

[56] References Cited

U.S. PATENT DOCUMENTS

| | | | |
|---|---|---|---|
| 3,023,490 | 6/1962 | Dawson | 29/194 |
| 3,419,415 | 12/1968 | Dittrich | 117/100 |
| 3,512,962 | 5/1970 | Holtz, Jr. | 75/0.5 BC |
| 3,515,540 | 6/1970 | Meadows | 75/0.5 BC |
| 3,743,499 | 7/1973 | Ramqvist | 75/0.5 BB |
| 4,136,230 | 1/1979 | Patel | 428/564 |
| 4,402,737 | 9/1983 | Kononwetter et al. | 75/0.5 B |

FOREIGN PATENT DOCUMENTS 867455 10/1961 United Kingdom .

*Primary Examiner*—Christopher W. Brody
*Attorney, Agent, or Firm*—E. T. Grimes; H. S. Ingham

[57] ABSTRACT

A cobalt bonded tungsten carbide powder is produced by a method comprising preparing a mixture consisting of a first tungsten carbide powder having a particle size of −5 microns, a second tungsten carbide powder having a particle size of −44+10 microns, a cobalt powder having a particle size of −5 microns and a carbon powder having a particle size of −1 micron. The mixture has proportions, by weight totaling 100%, of about 10% to 30% first tungsten carbide, 40% to 80% second tungsten carbide, 8% to 25% cobalt and 0.5 to 3% carbon. The mixture is processed by compacting, sintering, crushing, and classifying to produce the cobalt bonded tungsten powder in a size range −100+10 microns.

7 Claims, No Drawings

TUNGSTEN CARBIDE POWDER AND METHOD OF MAKING FOR FLAME SPRAYING

The present invention relates to thermal spraying and particularly to a tungsten carbide powder useful for flame spraying.

BACKGROUND OF THE INVENTION

Thermal spraying involves the heat softening of a heat fusible material such as metal, carbide or ceramic, and propelling the softened material in particulate form against a surface which is to be coated. The heated particles strike the surface where they are quenched and bonded thereto. A conventional thermal spray gun is used for the purpose of both heating and propelling the particles. In one type of thermal spray gun, the heat fusible material is supplied to the gun in powder form. Such powders are typically comprised of small particles, e.g., between 100 mesh U.S. Standard screen size (150 microns) and about 5 microns.

The term "flame spraying" as used herein specifically means a combustion spray process as a species of the broader group of thermal spray processes. A thermal spray gun normally utilizes a combustion or plasma flame to produce the heat for melting of the powder particles. It is recognized by those of skill in the art, however, that other heating means may be used as well, such as electric arcs, resistance heaters or induction heaters, and these may be used alone or in combination with other forms of heaters. In a powder-type combustion flame spray gun, the carrier gas, which entrains and transports the powder, can be one of the combustion gases or an inert gas such as nitrogen, or it can be simply compressed air. In a plasma spray gun, the primary plasma gas is generally nitrogen or argon, and hydrogen or helium is usually added to the primary gas.

The material alternatively may be fed into a heating zone in the form of a rod or wire. In the wire type thermal spray gun, the rod or wire of the material to be sprayed is fed into the heating zone formed by a flame of some type, such as a combustion flame, where it is melted or at least heat-softened and atomized, usually by blast gas, and thence propelled in finely divided form onto the surface to be coated. The rod or wire may be conventionally formed as by drawing, or may be formed by sintering together a powder, or by bonding together the powder by means of an organic binder or other suitable binder which disintegrates in the heat of the heating zone, thereby releasing the powder to be sprayed in finely divided form.

Since wear resistance is a common requirement for thermal sprayed coatings, carbide powders have been of considerable interest for spraying. Carbides such as tungsten carbide, without any binder ("neat"), oxidize and lose carbon during the high temperature spraying process. An effort to minimize these effects is disclosed in U.S. Pat. No. 3,419,415, originally assigned to a predecessor in interest of the assignee of the present application, whereby a composite powder is formed of the carbide with excess carbon. However this method has not been particularly successful and apparently has never been commercially developed.

British patent specification No. 867,455, also originally assigned to predecessor in interest of the present assignee, typifies metal bonded carbide powder admixed with a sprayweld self-fluxing alloy powder for spraying. Often the coating is subsequently fused. The addition of fuseable self-fluxing alloy not only adds time and cost to the process but results in a lesser amount of carbide in the coating. U.S. Pat. No. 4,136,230 (Patel) illustrates typical grain sizes of tungsten carbide particles in a self-fluxing alloy matrix in a fused flame sprayed coating.

U.S. Pat. No. 3,023,490 teaches a coating comprising large and small particles of tungsten carbide in a fusible alloy matrix. This coating is formed by applying powders in a paste onto a substrate and torch fusing the coating in place, a process not widely competitive with thermal spraying.

Therefore, tungsten carbide powder developed for thermal spraying has generally required binders of additional materials in the powder. Firstly, since tungsten carbide itself does not melt properly in the flame, and also is too brittle for practical coatings, a metal such as cobalt or nickel is incorporated into the powder. Such a powder is produced by fusing or sintering with the metal, and crushing the product, as taught in the aforementioned British patent. Secondly, combustion flame spraying tends to oxidize and decarburize neat metal bonded carbide powder. Also thermal spraying tends to cause the carbide to go into solution in the matrix. High velocity plasma minimizes these effects to produce excellent results. However for combustion flames spray processes the powder is generally admixed with another flame spray material.

When plasma and detonation processes were developed around 1960, the spraying of powders such as cobalt bonded tungsten carbide (without admixture) became quite successful for producing highly wear resistant coatings. However the apparatus for these processes are expensive and not very portable, thus limiting applications. The more portable and economically reasonable combustion flame spray processes still have generally not been successful in spraying high quality cobalt bonded tungsten carbide coatings without added self-fluxing alloy.

SUMMARY OF THE INVENTION

Therefore, objects of the present invention are to provide an improved carbide powder for thermal spraying, and particularly to provide a novel cobalt bonded tungsten carbide powder useful for flame spraying without requiring admixture, and to provide a novel method of making such powder.

The foregoing and other objects are achieved with a cobalt bonded tungsten carbide powder produced by a method comprising preparing a mixture consisting essentially of a first tungsten carbide powder having a particle size of −5 microns, a second tungsten carbide powder having a particle size of −44+10 microns, a cobalt powder having a particle size of −5 microns and a carbon powder having a particle size of −1 micron. The mixture has proportions, by weight totaling 100%, of about 10% to 30% first tungsten carbide, 40% to 80% second tungsten carbide, 8% to 25% cobalt and 0.5 to 3% carbon. The mixture is processed by compacting the mixture to produce a compacted product, sintering the compacted product to produce a sintered product, crushing the sintered product to produce a crushed product, and classifying the crushed product to produce the cobalt bonded tungsten powder in a size range −150+5 microns. Preferably the sintering is effected such as to produce tungsten carbide crystals in a cobalt matrix, the crystals having a size predominantly −30+1 microns.

DETAILED DESCRIPTION OF THE INVENTION

According to the present invention a powder is produced by utilizing two different sizes of precursor tungsten carbide powders in a mixture. The tungsten carbides are preferably WC, but may be $W_2C$ or the eutectic of these two chemistries or the like, and need not be the same as each other. The first carbide is quite fine and has a particle size less than about 5 microns. The second tungsten carbide powder is relatively coarse and has a particle size of substantially −44+10 microns. These precursors are blended with a cobalt powder having a particle size of −5 microns. Further according to the present invention, carbon powder having a particle size of −1 micron is included in the mixture.

Preferably the first tungsten carbide powder has a particle size of about 0.3 to 1.2 microns, the second tungsten carbide powder a particle size of about 20 to 30 microns, the cobalt powder a particle size less than about 1.5 microns and the carbon powder a particle size less than about 0.5 microns. Also, preferably, the mixture is prepared in proportions of about 21% first tungsten carbide, 60% second tungsten carbide, 18% cobalt and 1% carbon.

The mixture should have proportions, by weight totaling 100%, of about 10% to 30% first tungsten carbide, 40% to 80% second tungsten carbide, 8% to 25% cobalt and 0.5 to 3% carbon. The mixture optionally may be mechanically blended such as by milling into a blended product sufficient for the ingredients to be thoroughly and intimately mixed. The resulting powder is next compacted into sintered product blanks of convenient size, and sintered.

The milling, compacting and sintering generally are carried out according to practices conventionally used to produce tool blanks except that sintering time and temperature should receive particular care. The sintering should be such as produce a sintered product formed of a hard, dense aggregate with minimum of growth of the tungsten carbide crystals in the cobalt matrix. The resulting tungsten crystals in the cobalt matrix should be predominantly −30+1 microns in size, and preferably 2 to 10 microns with substantially no particles exceeding 30 microns. This structure results primarily by way of the fine, first carbide particles dissolving into the matrix, and the larger, second carbide particles partially dissolving so as to be reduced in size. Some of the added carbon also may be expected to dissolve and/or react with other constituents.

The sintered product is crushed by a conventional roll mill to produce a crushed product as close to the final size as practical. Classifying as by elutriation, cyclone separation and/or screening is effected to produce the final grade of cobalt bonded tungsten powder. The size should be generally in the size range normally associated with a flame spray powder, namely −150+5 microns, preferably −53+10 microns. Alternatively, for very fine texture coatings a desirable size is −44+5 microns.

Spraying may be effected with any conventional thermal spray gun, but the powder of the present invention is especially suitable for use with a combustion flame spray gun. The substrate surface such as steel is prepared by conventional grit blasting although there is self-bonding such that thin coatings may be applied to smooth clean surfaces. Coatings up to 1.5 mm thick may be applied to flat, grit blasted carbon steel panels.

The powders are sprayed in the conventional manner, using a powder-type thermal spray gun, though it is also possible to combine the same into the form of a composite wire or rod, using plastic or a similar binder, as for example, polyethylene or polyurethane, which decomposes in the heating zone of the gun. The rods or wires should have conventional sizes and accuracy tolerances for flame spray wires and thus, for example, may vary in size between 6.4 mm and 20 gauge.

High quality coatings are achieved, with high bond strength and excellent resistance to abrasion, low angle erosion and corrosion. Typical applications are fan blades, pump seals, thread guides, wire drawing capstans and mandrels. The portability of a flame spray gun allows coatings to be applied in the field. The following example is by way of illustration and not limitation.

EXAMPLE

A powder mixture was prepared consisting of, by weight, 21% of a first crystalline tungsten carbide (WC) 0.3 to 1.2 microns size, 60% of a second crystalline tungsten carbide (WC) 20 to 30 microns size, 18% of a 99+% purity cobalt powder less than 1.5 micron size, and 1% carbon in the form of graphite less than 0.5 microns size. The resulting powder was compacted into blanks which were sintered in vacuum for 30 minutes at 1300° C. The sintered product was then crushed by conventional roll crushers in a series of 2 to 3 rollers, removing the coarse particles, and screened to −53+10 microns. The size distribution was about 80%+44 microns and 20%−44 microns. The resulting powder contained about 74% tungsten, 21% cobalt, and 5% carbon of which free free carbon was between 0.33 and 0.5% (of the total product).

The final powder was flame sprayed with a Metco Type 6P flame spray gun sold by The Perkin-Elmer Corporation, Westbury NY, using a P7C-D nozzle, and an Air Jet Unit with 50 psi (3.5 kg/cm$^2$) air through crossed jets at 6.4 cm. Oxygen was 29 l/min. (std.) at 35 psi (2.5 kg/cm$^2$) and acetylene 22 l/min. at 15 psi (1.0 kg/cm$^2$). A Metco Type 3MP powder feeder was used with nitrogen carrier of 7.1 l/min. at 55 psi (3.9 kg/cm$^2$) and spray rate of 4.5 kg/hr. Spray distance was 8 cm and deposit efficiency was 80%.

Bond strength on grit blasted steel exceeded 8000 psi (562 kg/cm$^2$). Coating density measured 12.5 gm/cc with less than 2% porosity. The amount of tungsten carbides out of solution (metallographically visible) was 17–20%. Macrohardness was Rc56–59, microhardness DPH 850–950. As spray finish measured 350–450 microinches, and grind finish with a diamond grinding wheel was less than 4 microinches.

Abrasive wear resistance was measured by the following procedure:

1. Measure the thickness of the test buttons (including coating) in four places, using a supermicrometer, and record the readings. (Locate the four points for a subsequent measurement by placing marks or numbers on the periphery of the button).
2. Weigh each button accurately, using an analytical balance, and record the weight.
3. Insert a drive assembly in a drill press spindle.
4. Place a platform scale on the drill press table. Pull the drill press arm (handle) down to a horizontal position and lock it in place.
5. Raise the drill press table and affix a 1400 g load on the handle.

6. Unlock the drill press spindle. Hang the weight on the press arm.

7. Remove the scale.

8. Raise the spindle and replace the aligning pin with a 3.18 cm blank pin.

9. Place two test buttons on a wear track. Lower the spindle until drive pins enter the drive holes in the buttons. Lock in place, with no load on the buttons.

10. Start the drill press. Pour into a pan a thoroughly mixed slurry of alumina abrasive powder −53 microns +15 microns in a slurry of 150 grams of abrasive in 500 cc of water. Release the lock on the spindle so that the 1400 g load is applied. Record the starting time.

11. Allow the test to run 10 minutes.

12. Remove the buttons and wash them in solvent. Weigh and measure the thicknesses and record the readings for comparison with the original headings.

13. Run the test three times and average the results.

Comparison of abrasive wear resistance was made against a conventional plasma sprayed coating of Metco 73F-NS which is 12% cobalt bonded tungsten carbide. The measurements showed that the conventional coating lost 1.1 times the thickness loss of the carbide coating of the present example, and 0.8 times the volume loss.

Erosion resistance was measured by impinging −53+15 microns aluminum oxide in compressed air at 60 psi (4.2 kg/cm$^2$) through a 3.3 mm diameter nozzle at various angles to the surface of the coating. Volume loss (in $10^{-4}$ cm$^3$) at 20° was 0.39, at 45° was 0.44, and at 90° was 1.23. Comparable results for the conventional 73F-NS were 0.39, 0.62 and 1.12 respectively.

Thus a cobalt bonded tungsten carbide coating was achieved by flame spraying a powder according to the present invention, which performed quite similarly to state-of-the-art plasma carbide coatings. It may be appreciated that the powder of the present invention is best described in terms that include the method of making the powder. This is particularly so because the fine size, first tungsten carbide precursor powder dissolves in the cobalt matrix to become unidentifiable. Thus it has been discovered that powder made according to the method of the invention results in significantly improved quality flame spray coatings.

While the invention has been described above in detail with reference to specific embodiments, various changes and modifications which fall within the spirit of the invention and scope of the appended claims will become apparent to those skilled in this art. The invention is therefore only intended to be limited by the appended claims or their equivalents.

What is claimed is:

1. A method of making a cobalt bonded tungsten carbide powder useful for flame spraying, comprising:

preparing a mixture consisting essentially of a first tungsten carbide powder having a particle size of −5 microns, a second tungsten carbide powder having a particle size of −44+10 microns, a cobalt powder having a particle size of −5 microns and a carbon powder having a particle size of −1 micron, the mixture having proportions, by weight totaling 100%, of about 10% to 30% first tungsten carbide, 40% to 80% second tungsten carbide, 8% to 25% cobalt and 0.5 to 3% carbon; and processing the mixture by compacting the mixture to produce a compacted product, sintering the compacted product to produce a sintered product, crushing the sintered product to produce a crushed product, and classifying the crushed product to produce the cobalt bonded tungsten powder.

2. A method according to claim 1 wherein the first tungsten carbide powder has a particle size of about 0.3 to 1.2 microns, the second tungsten carbide powder has a particle size of about 20 to 30 microns, the cobalt powder has a particle size less than about 1.5 microns and the carbon powder has a particle size less than about 0.5 microns.

3. A method according to claim 2 wherein the mixture is prepared in proportions of about 21% first tungsten carbide, 60% second tungsten carbide, 18% cobalt and 1% carbon.

4. A method according to claim 1 wherein the mixture is prepared in proportions of about 21% first tungsten carbide, 60% second tungsten carbide, 18% cobalt and 1% carbon.

5. A method according to claim 1 wherein the sintering is effected such as to produce tungsten carbide crystals in a cobalt matrix, the crystals having a size predominantly −30+1 microns.

6. A method of making a cobalt bonded tungsten carbide powder useful for flame spraying, comprising:

preparing a mixture consisting of a first tungsten carbide powder having a particle size of about 0.3 to 1.2 microns, a second tungsten carbide powder having a particle size of about 20 to 30 microns, a cobalt powder having a particle size of less than about 1.5 microns and a carbon powder having a particle size of 0.5 microns, the mixture having proportions of about 21% first tungsten carbide, 60% second tungsten carbide, 18% cobalt and 1% carbon; and processing the mixture by compacting the mixture to produce a compacted product, sintering the compacted product to produce a sintered product, crushing the sintered product to produce a crushed product, and classifying the crushed product to produce the cobalt bonded tungsten powder; wherein the sintering is effected such as to produce tungsten carbide crystals in a cobalt matrix, the crystals having a size predominantly −30+1 microns.

7. A cobalt bonded tungsten carbide powder characterized by a capability of being combustion flame sprayed to produce a coating of plasma sprayed quality, comprising a cobalt matrix containing a first tungsten carbide and carbon each dissolved therein, and crystals of a second tungsten carbide in the cobalt matrix, the crystals having size predominantly −30+1 microns and the cobalt bonded tungsten carbide powder being produced by the method of claim 1 or claim 2 or claim 3 or claim 4 or claim 6.

* * * * *